US011133171B2

(12) United States Patent
Vestal et al.

(10) Patent No.: US 11,133,171 B2
(45) Date of Patent: Sep. 28, 2021

(54) METHOD AND APPARATUS FOR TANDEM MASS SPECTROMETRY WITH MALDI-TOF ION SOURCE

(71) Applicant: Virgin Instruments Corporation, Marlborough, MA (US)

(72) Inventors: Marvin L. Vestal, Framingham, MA (US); Sicheng Li, Sudbury, MA (US)

(73) Assignee: Virgin Instruments Corporation, Marlborough, MA (US)

( * ) Notice: Subject to any disclaimer, the term of this patent is extended or adjusted under 35 U.S.C. 154(b) by 0 days.

(21) Appl. No.: 16/942,674

(22) Filed: Jul. 29, 2020

(65) Prior Publication Data

US 2021/0035792 A1 Feb. 4, 2021

Related U.S. Application Data

(60) Provisional application No. 62/881,349, filed on Jul. 31, 2019.

(51) Int. Cl.

| | |
|---|---|
| ***H01J 49/16*** | (2006.01) |
| ***H01J 49/40*** | (2006.01) |
| ***H01J 49/00*** | (2006.01) |
| ***H01J 49/06*** | (2006.01) |
| ***H01J 49/04*** | (2006.01) |

(52) U.S. Cl.

CPC ..... *H01J 49/164* (2013.01); *H01J 49/0045* (2013.01); *H01J 49/0418* (2013.01); *H01J 49/061* (2013.01); *H01J 49/067* (2013.01); *H01J 49/401* (2013.01)

(58) Field of Classification Search

CPC ..... H01J 49/0164; H01J 49/0045; H01J 49/0418; H01J 49/061; H01J 49/067; H01J 49/401

See application file for complete search history.

(56) References Cited

U.S. PATENT DOCUMENTS

| | | | |
|---|---|---|---|
| 8,735,810 | B1 | 5/2014 | Vestal |
| 9,543,138 | B2 | 1/2017 | Vestal et al. |

*Primary Examiner* — Nicole M Ippolito
*Assistant Examiner* — Hanway Chang
(74) *Attorney, Agent, or Firm* — Rauschenbach Patent Law Group; Kurt Rauschenbach

(57) ABSTRACT

A MALDI ion source for tandem mass spectrometers includes a pulsed energy source that generates a pulse of ions from a sample on a sample plate. An ion accelerator includes an input that receives the pulse of ions from the pulsed energy source and generates an electric field that accelerates the pulse of ions. An ion decelerator that generates an electric field that is a mirror image of the electric field generated by the ion accelerator that accelerates the pulse of ions so that the ion decelerator decelerates the accelerated pulse of ions and transmits the decelerated pulse of ions through an exit aperture.

23 Claims, 10 Drawing Sheets

A TANDEM MASS SPECTROMETER

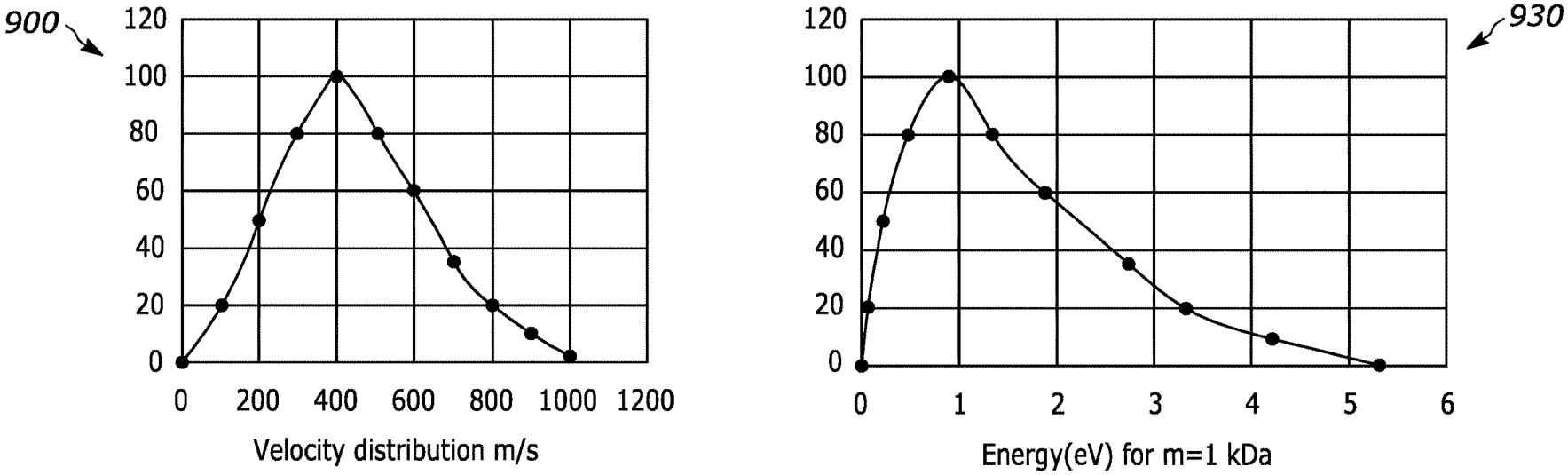
FIG. 9A
FIG. 9B
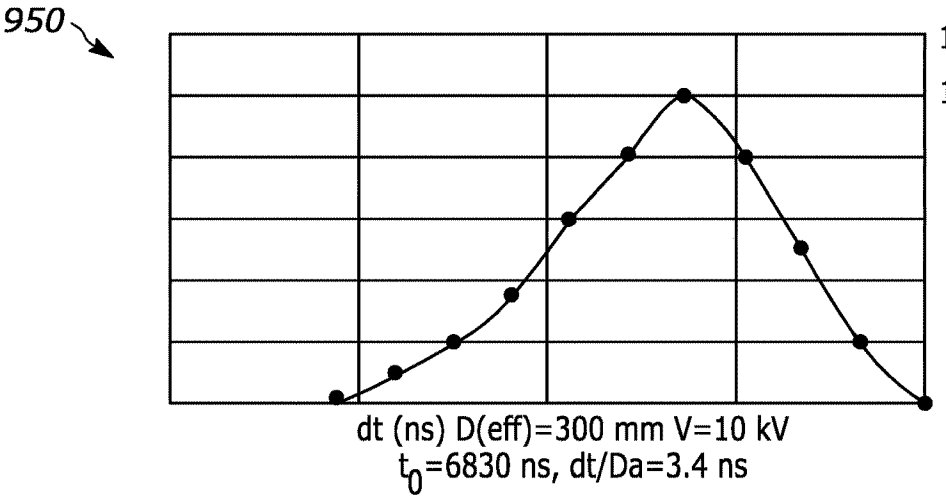
FIG. 9C

METHOD AND APPARATUS FOR TANDEM MASS SPECTROMETRY WITH MALDI-TOF ION SOURCE

CROSS REFERENCE TO RELATED APPLICATION

The present application is a non-provisional application of U.S. Provisional Patent Application No. 62/881,349 filed on Jul. 31, 2019, entitled "Method and Apparatus for Tandem Mass Spectrometry with MALDI-TOF Ion Source". The entire contents of U.S. Provisional Patent Application No. 62/881,349 are herein incorporated by reference. This patent application is also related to U.S. Pat. No. 9,543,138 entitled "Ion Optical System for MALDI-TOF Mass Spectrometer" and to U.S. Pat. No. 8,735,810 entitled "Time-of-Flight Mass Spectrometer with Ion Source and Ion Detector Electrically Connected". U.S. Pat. Nos. 9,543,138 and 8,735,810 are incorporated herein by reference.

The section headings used herein are for organizational purposes only and should not to be construed as limiting the subject matter described in the present application in any way.

INTRODUCTION

The first practical time-of-flight (TOF) mass spectrometer (MS) was described by Wiley and McClaren more than 50 years ago. TOF mass spectrometers were generally considered to be only a tool for exotic studies of ion properties for many years. See, for example, "Time-of-Flight Mass Spectrometry: Instrumentation and Applications in Biological Research," Cotter R J., American Chemical Society, Washington, D.C. 1997, for review of the history, development, and applications of TOF-MS in biological research.

Early TOF mass spectrometer systems included ion sources with electron ionization in the gas phase where a beam of electrons is directed into the ion source. The ions produced have a distribution of initial positions and velocities that is determined by the intersection of the electron beam with the neutral molecules present in the ion source. The initial position of the ions and their velocities are independent variables that affect the flight time of the ions in a TOF-MS. Wiley and McLaren developed and demonstrated methods for minimizing the contribution of each of these distributions. Techniques for minimizing the contribution of initial position are called "space focusing" techniques. Techniques for minimizing the contribution of initial velocity are called "time lag focusing" techniques. One important conclusion made by Wiley and McLaren is that it is impossible to simultaneously achieve both space focusing and velocity focusing. Optimization of these TOF mass spectrometers required finding the optimum compromise between the space focusing and velocity focusing distributions.

Many mass spectrometer applications require an accurate determination of the molecular masses and relative intensities of metabolites, peptides, and intact proteins in complex mixtures, which is challenging. Some known mass spectrometers utilize tandem mass spectrometry to provide information on the structure and sequence of many biological polymers and allow unknown samples to be accurately identified. Tandem mass spectrometers employ a first mass analyzer to produce, separate and select a precursor ion, and a second mass analyzer to fragment the selected ions and record the fragment mass spectrum from the selected precursor. As the applications for mass spectrometer instrumentation and associated data grow, new and improved tandem mass spectrometer methods and apparatus are needed.

BRIEF DESCRIPTION OF THE DRAWINGS

The present teaching, in accordance with preferred and exemplary embodiments, together with further advantages thereof, is more particularly described in the following detailed description, taken in conjunction with the accompanying drawings. The skilled person in the art will understand that the drawings, described below, are for illustration purposes only. The drawings are not necessarily to scale, emphasis instead generally being placed upon illustrating principles of the teaching. The drawings are not intended to limit the scope of the Applicant's teaching in any way.

FIG. 9A illustrates a graph of the relative intensity as a function of ion velocity for ions produced by an embodiment of the MALDI tandem mass spectrometer of the present teaching.

FIG. 9B illustrates a graph of the relative intensity as a function of their calculated energy produced by an embodiment of the MALDI tandem mass spectrometer of the present teaching.

FIG. 9C illustrates a graph of the relative intensity as a function of the ion time distribution at the exit aperture from the decelerator produced by an embodiment of the MALDI tandem mass spectrometer of the present teaching.

DESCRIPTION OF VARIOUS EMBODIMENTS

Figure 1:
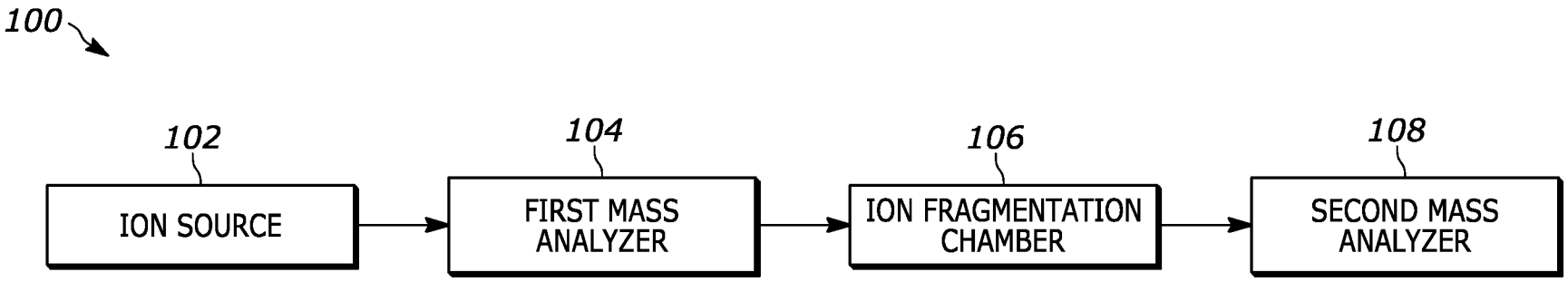
FIG. 1 illustrates a block diagram of a tandem mass spectrometer.

The present teaching will now be described in more detail with reference to exemplary embodiments thereof as shown in the accompanying drawings. While the present teachings are described in conjunction with various embodiments and examples, it is not intended that the present teachings be limited to such embodiments. On the contrary, the present teachings encompass various alternatives, modifications and equivalents, as will be appreciated by those of skill in the art. Those of ordinary skill in the art having access to the teaching herein will recognize additional implementations, modifications, and embodiments, as well as other fields of use, which are within the scope of the present disclosure as described herein.

Reference in the specification to "one embodiment" or "an embodiment" means that a particular feature, structure, or characteristic described in connection with the embodiment is included in at least one embodiment of the teaching. The appearances of the phrase "in one embodiment" in various places in the specification are not necessarily all referring to the same embodiment.

It should be understood that the individual steps of the methods of the present teachings can be performed in any order and/or simultaneously as long as the teaching remains operable. Furthermore, it should be understood that the apparatus and methods of the present teachings can include any number or all of the described embodiments as long as the teaching remains operable.

The advent of naturally pulsed ion sources such as CF plasma desorption ions source, static secondary ion mass spectrometry (SIMS), and matrix-assisted laser desorption/ionization (MALDI) ion sources has led to renewed interest in TOF mass spectrometers. Recent work in TOF mass spectrometry has focused on developing new and improved TOF instruments and software that take advantage of MALDI and electrospray (ESI) ionization sources. These ionization sources have removed the volatility barrier for mass spectrometry and have facilitated the use of mass spectrometers for many important biological applications.

It is desirable for mass spectrometers to provide an accurate determination of the molecular masses and relative intensities of metabolites, peptides, and intact proteins in complex mixtures. The use of tandem mass spectrometry provides information on the structure and sequence of many biological polymers. Tandem mass spectrometers employ a first mass analyzer to produce, separate and select a precursor ion, and a second mass analyzer to fragment the selected ions and record the fragment mass spectrum from the selected precursor. A wide variety of mass analyzers and combinations thereof for use in tandem mass spectrometry are known in the literature.

An important advantage of TOF-MS is that essentially all of the ions produced are detected, which is not the case for scanning MS instruments. In conventional MS-MS tandem instruments, all of the ions produced are not detected because each precursor is selected sequentially and all non-selected ions are lost. This limitation of conventional MS-MS tandem instruments can be overcome by selecting multiple precursors following each laser shot. Recording fragment spectra from each of the multiple selected precursors can partially overcome the loss of non-selected ions and dramatically improve speed and sample utilization without requiring the acquisition of raw spectra at a higher rate.

FIG. 1 illustrates a block diagram of a tandem mass spectrometer 100. An ion source 102 generates ions from a sample that are sent to a first mass analyzer 104. The mass analyzer 104 separates the generated ions by their mass-to-charge ratio, and selected ions of particular mass-to-charge ratio(s) are sent to an ion fragmentation chamber 106, where they are split into smaller fragment ions. The fragments from the ion fragmentation chamber 106 are sent to a second mass analyzer 108 that is used to separate the fragmented ions by mass-to-charge ratio and detect them.

Figure 2:
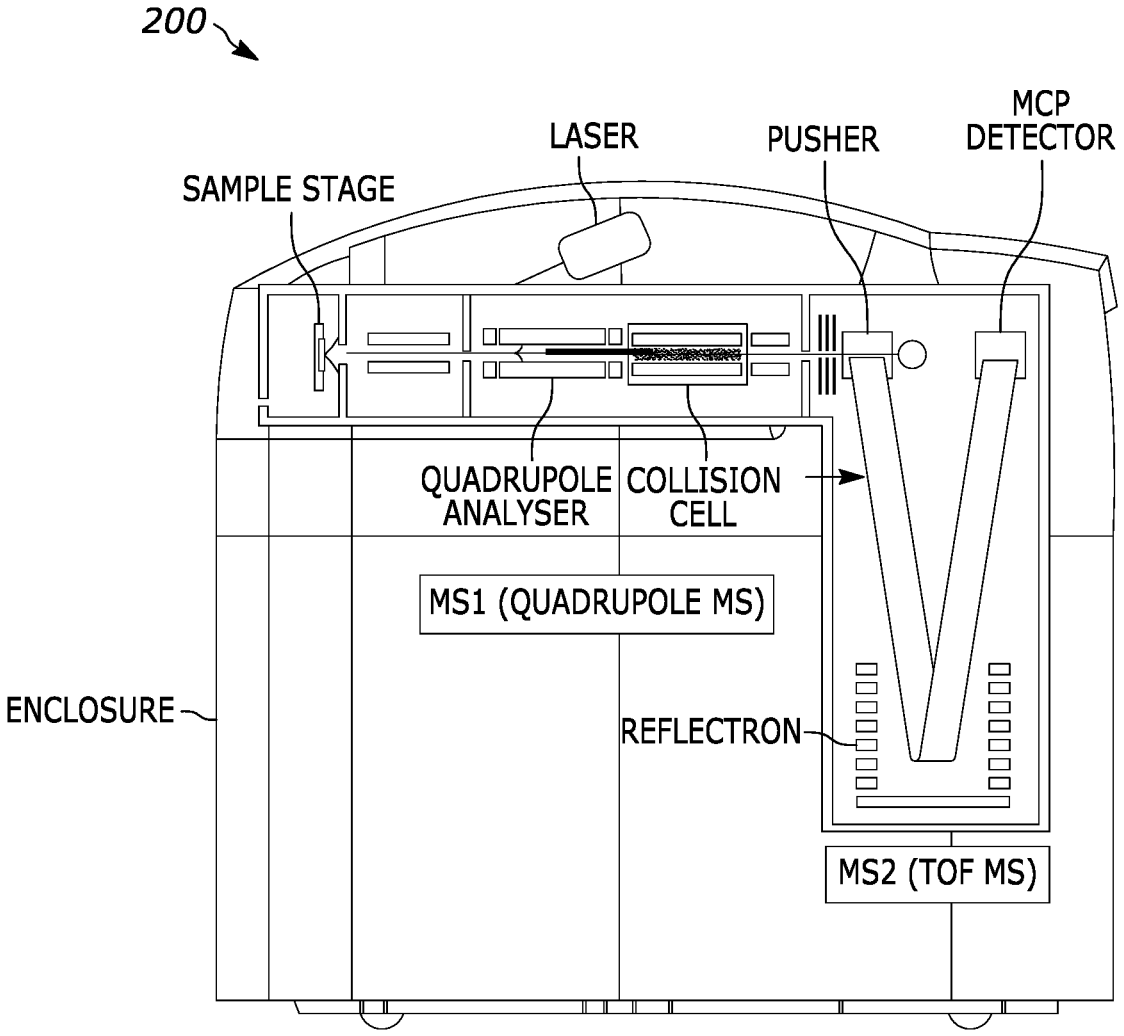
PRIOR ART FIG. 2
FIG. 2 illustrates a schematic drawing of known Q-TOF tandem mass spectrometer.

There are many types of tandem mass spectrometers known in the art. One particular type of tandem mass spectrometer is a Q-TOF tandem mass spectrometer. FIG. 2 illustrates a schematic of known Q-TOF tandem mass spectrometer 200. The Q-TOF tandem mass spectrometer 200 is a Micromass Q-TOF. Micromass is a registered trademark of Waters, Corporation in Milford, Mass. The Q-TOF tandem mass spectrometer 200 combines a quadrupole mass spectrometer as a first stage with a time-of-flight analyzer as the second stage. These Q-TOF tandem mass spectrometers 200 are successfully employed in a wide variety of applications, particularly those that utilize gas phase ionization techniques such as electrospray. These TOF tandem mass spectrometer instruments 200 have also been used with MALDI ionization, but with less widespread success.

In this Q-TOF tandem mass spectrometer 200, the laser beam strikes the ion source at an angle relative to the axis of the quadrupole, and passes between the poles of a quadrupole or hexapole ion guide. Ions and neutrals desorbed by the laser are transmitted to the ion guide with the ions being transmitted to the quadrupole analyzer and most of the neutral matrix molecules being deposited on the rods of the ion guide. There are at least two major problems with this configuration. Since the ion guides operate at relatively low voltage, a first problem is that deposition of matrix produces an insulating film that causes surface charging so that frequent cleaning of the ion guide is required to maintain acceptable performance. Secondly, essentially all of the ions produced by the laser, including those from the matrix, are transmitted into the quadrupole analyzer. Often the total intensity of matrix ions is 6 to 9 orders of magnitude greater than that of ions of interest. This can result in greatly reduced sensitivity due to the 'chemical noise" generated by the matrix.

One feature of apparatus of the present teaching is that they overcome the known problems with Q-TOF tandem mass spectrometers 200. This advantage is achieved, at least in part, by replacing the MALDI source and quadrupole analyzer with a first mass spectrometer. Another feature of the apparatus of the present teaching is that it can be constructed to integrate with Q-TOF tandem mass spectrometer 200. Some embodiments of the apparatus of the present teaching can fit into the enclosure of the Q-TOF tandem mass spectrometer 200.

Figure 3:
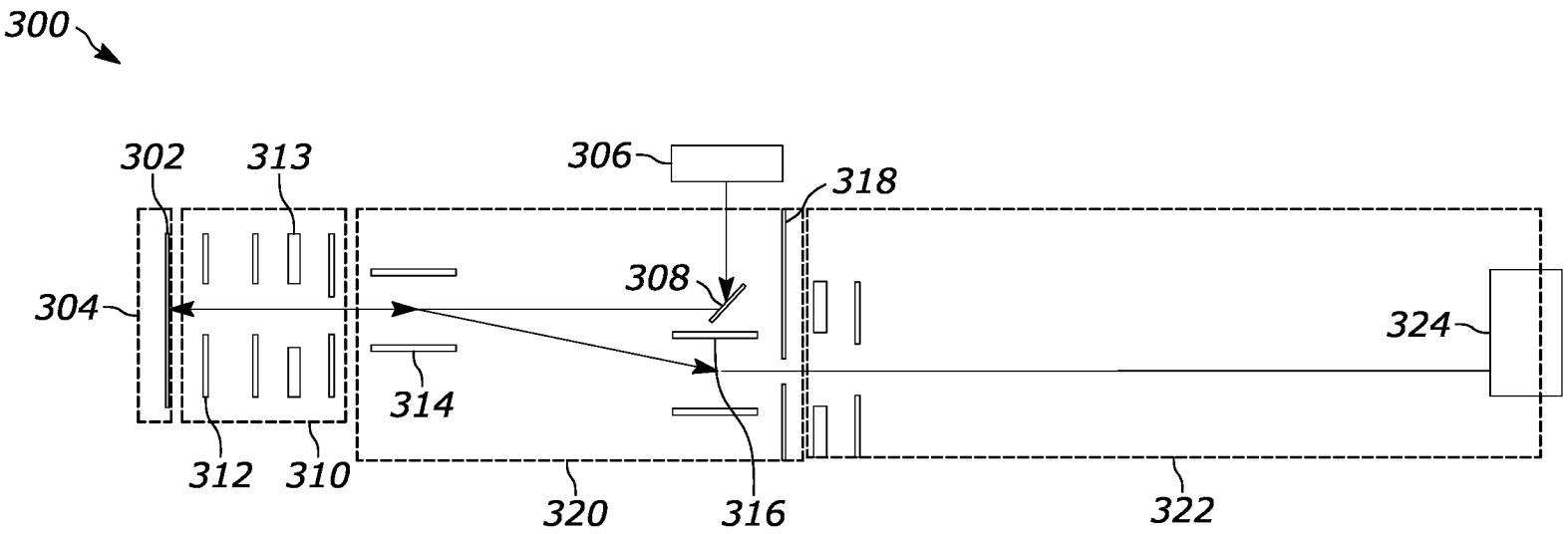
FIG. 3 illustrates a schematic drawing of a known MALDI-TOF mass spectrometer.

FIG. 3 illustrates a known MALDI-TOF mass spectrometer. See, for example, U.S. Pat. No. 9,543,138, entitled Ion Optical System for MALDI-TOF Mass Spectrometer, which is assigned to the present assignee and which is incorporate herein by reference. Samples are loaded on a sample plate 302 that is supported by a sample plate receiver 304 which may be located on an X-Y motion stage (not shown). The sample plate 302 is held in some embodiments at nominally ground potential. The sample plate in this embodiment is a MALDI sample plate 302. Laser pulses from a laser 306 are directed to the sample plate 302 so they impinge on a sample for analysis and generate ions. The laser pulses are reflected by a mirror 308 so that they travel within a small angle coaxial with an ion beam produced by the laser pulses impinging the sample. Thus, the laser 306 produces laser pulses that, in turn, generate pulses of ions from samples on a sample plate 302. The ions from the sample are accelerated by an ion accelerator 310 that includes an extraction electrode 312 and focused by an ion lens 313 toward a first ion deflector 314.

The first deflector 314 deflects a portion of the ions to a second deflector 316 that deflects the ions to an aperture 316. The system of two ion deflectors 314, 316 and aperture 318 are referred to as ion optics 320 and serves to separate the ions from neutrals and into a mass analyzer 322 that includes an ion detector 324 that detects the ions. This MALDI-TOF spectrometer instrument 300 has demonstrated performance that far exceeds that of any other MALDI-TOF currently available.

Figure 4:
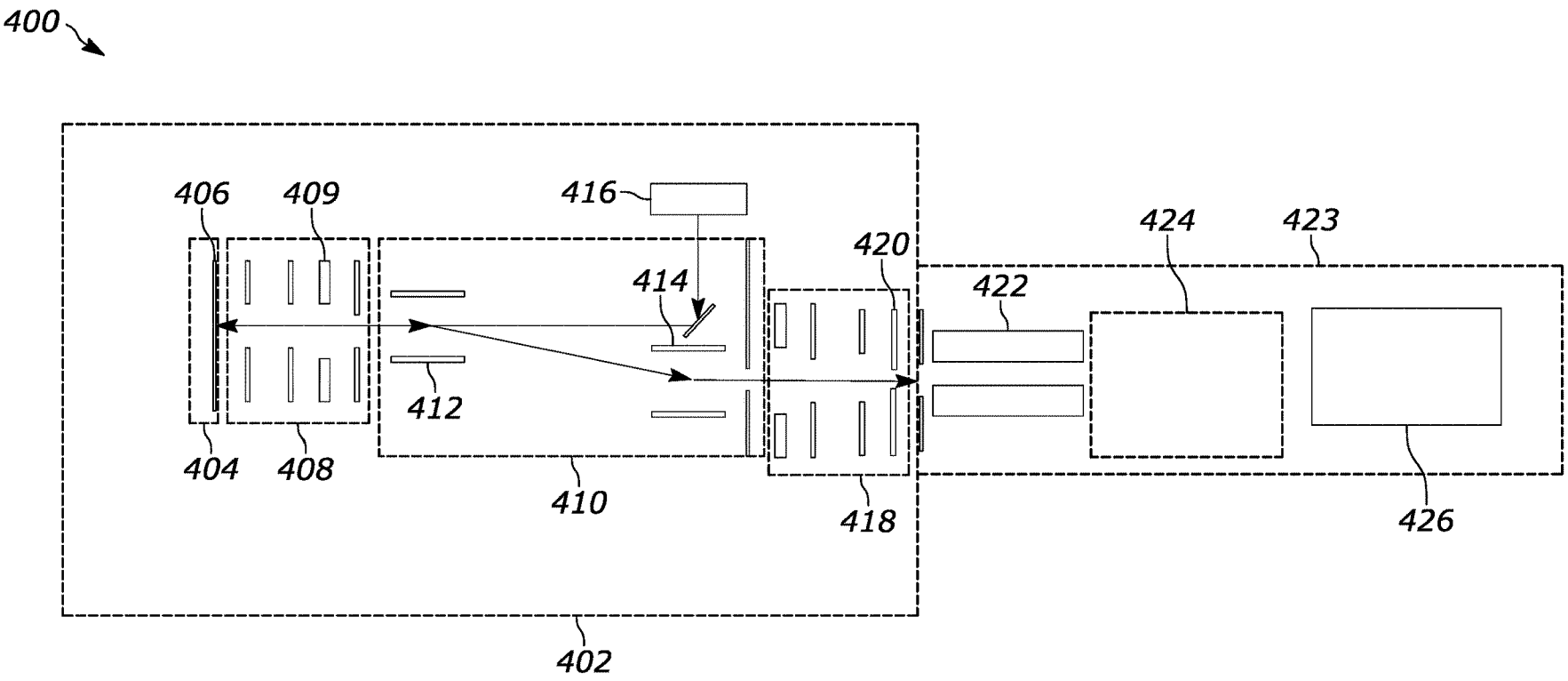
FIG. 4 illustrates an embodiment of a tandem TOF mass spectrometer with MALDI ion source of the present teaching.

FIG. 4 illustrates an embodiment of a tandem TOF mass spectrometer 400 with MALDI ion source of the present teaching. This design is derived from the MALDI-TOF mass spectrometer 300 shown in FIG. 3. The tandem TOF-MS instrument 400 includes a MALDI ion source 402 that includes a sample plate receiver 404 that may be positioned on an X-Y motion stage (not shown), a sample plate 406 attached to the receiver 404, an ion accelerator 408 that includes an ion lens 409, ion optics 410 with two deflectors 412, 414 and a laser 416 that are similar to those same elements described in connection with FIG. 3. The sample plate 406 in some embodiments is a MALDI sample plate.

There is an ion decelerator 418 that takes in ions from the output of the ion optics 410 and decelerates them to an exit aperture 420. The beam deflectors 412, 414 are used to direct and adjust the ion beam position and direction for any mechanical misalignments such that they pass through the exit aperture 420 with maximum transmission. Said another way, the ion decelerator 418 transmits decelerated ions through an exit aperture 420 at an output of the decelerator. In some embodiments, the potential applied to the exit aperture 420 is the same as the potential of the sample plate 406. In some embodiments, that potential is a zero potential. The exit aperture 420 in some embodiments is less than 100 micrometers in diameter. The size of the ion beam at the exit aperture in some embodiments is controlled by a lens. In some embodiments, the lens is configured to minimize the ion beam diameter at the exit aperture 420.

A quadrupole mass filter 422 takes in ions that pass through the exit aperture 420. The quadrupole mass filter 422 acts as a timed ion selector. The timed ion selector isolates, or selects, ions over a narrow mass range. The selected ions at the output of the quadrupole mass filter 422 are sent to a fragmentation chamber 424 and then to a second mass analyzer 426 that performs a mass spectrometry analysis on the fragments generated in the fragmentation chamber 424. The fragmentation chamber 424 may be, for example, a quadrupole ion fragmentation chamber or an electron capture fragmentation chamber. In some embodiments, the fragmentation chamber 424 may include one or more ion traps. The second mass analyzer 426 may be, for example, a time-of-flight mass analyzer, an orthogonal time-of-flight mass analyzer, or a quadrupole mass analyzer. In some embodiments, the system 423 that includes the quadrupole mass filter 422, fragmentation chamber 424 and second mass analyzer 426 may be all or part of an existing mass spectrometer system that is integrated with the MALDI ion source 402 of the present teaching. In some embodiments, the quadrupole mass filter 422 is a separate system that integrated with the MALDI ion source 402 and a separate fragmentation chamber 424 and mass spectrometer 426.

The addition of the ion decelerator 418 and quadrupole mass filter 422, also referred to as an ion selector, overcomes all of the problems found with earlier MALDI Q-TOF instruments, such as the one shown in FIG. 2. Note that other ion selectors can be used in some embodiments rather than the quadrupole mass filter 422. The ion selectors generally select and transmit ions through the selector and provide those ions that fall within a range of predetermined mass-to-charge ratios at an output. In particular the decelerator 418 efficiently transfers the ions of interest over a selected m/z range in a well-defined beam to the quadrupole analyzer 422 while removing the unwanted ions due to matrix and the chemical noise associated with these ions. Also, the neutral molecules are collected on surfaces that are at high potential and relatively immune to charging. The ion source does require occasional cleaning, but in recent applications, a stable performance is maintained even after more than 1 billion laser shots.

In the embodiment of the tandem TOF mass spectrometer 400 of FIG. 4, the source of pulsed ions comprises the laser 416, mirror 414 and MALDI sample plate 406 with MALDI-prepared sample. The laser pulses from the laser 416 produce ion pulses from the sample with MALDI matrix. This source of pulse ions may be called a pulsed energy source that generates a pulse of ions. In some embodiments of tandem TOF mass spectrometer of the present teaching, this pulsed energy source that generates a pulse of ions is replaced by a Secondary Ion Mass Spectrometer (SIMS) ion source, which is known in the art.

Figure 5:
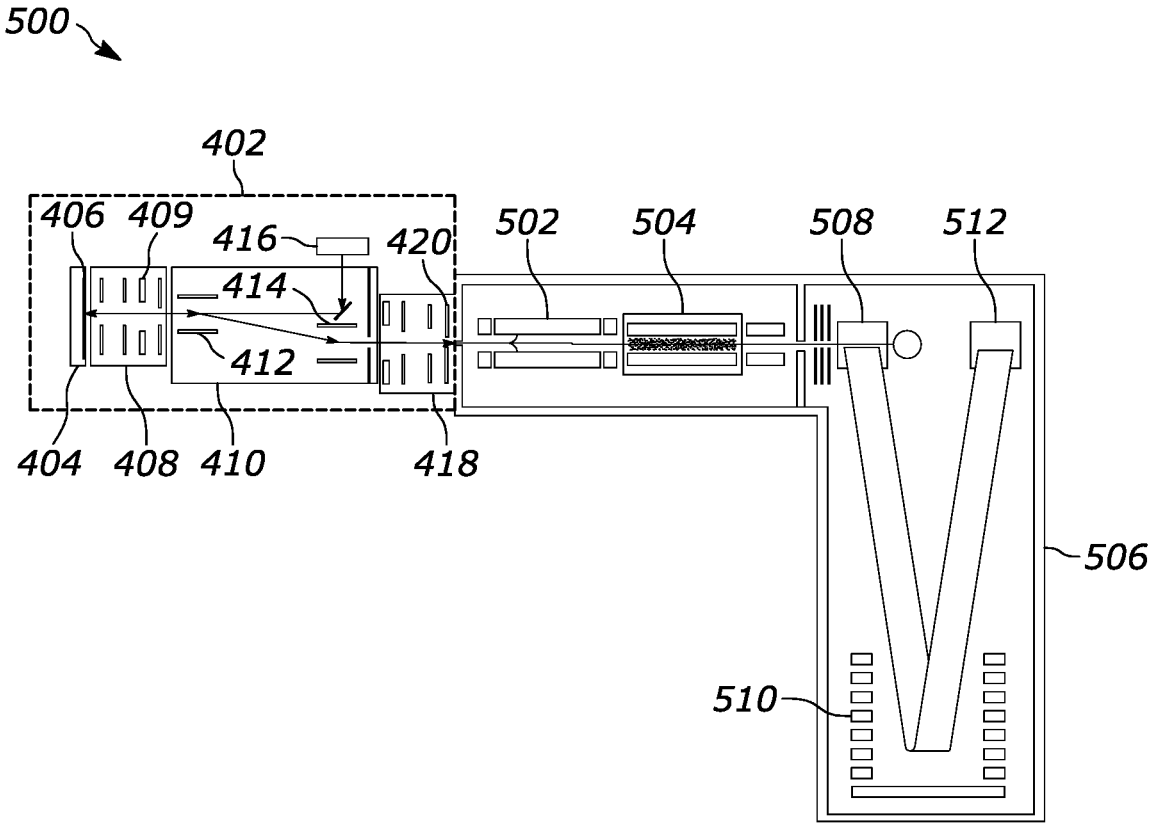
FIG. 5 illustrates an embodiment of a tandem mass spectrometer with MALDI ion source of the present teaching integrated with a portion of a known mass spectrometer system.

FIG. 5 illustrates an embodiment of a tandem mass spectrometer 500 with MALDI ion source of the present teaching integrated with a portion of a known mass spectrometer system of the present teaching. The MALDI ion source 402 includes a sample plate receiver 404, a sample plate 406, an ion accelerator 408 and lens 409, ion optics 410 with two deflectors 412, 414, a laser 416, an ion decelerator 418 and exit aperture 420. The output of the MALDI ion source 402 is provided to a quadrupole analyzer 502 and a collision cell 504 that fragments the ions and then to a second mass analyzer 506 that includes a pusher 506, a reflectron 510 and a micro-channel plate detector 512. In some embodiments, the quadrupole analyzer 502, collision cell 504, second mass analyzer 506, pusher 506, reflectron 510 and a micro-channel plate detector 512 are part of a known commercial mass spectrometer. A tandem mass spectrometer 500 configured in this way advantageously removes or significantly reduces the neutral molecules and/or unwanted ions provided to the second mass spectrometer 402 compared to prior art systems such as that shown in FIG. 2. In some embodiments, the tandem mass spectrometer 500 fits within an enclosure (not shown) of a known mass spectrometer system, such as that shown in FIG. 2.

Figure 6:
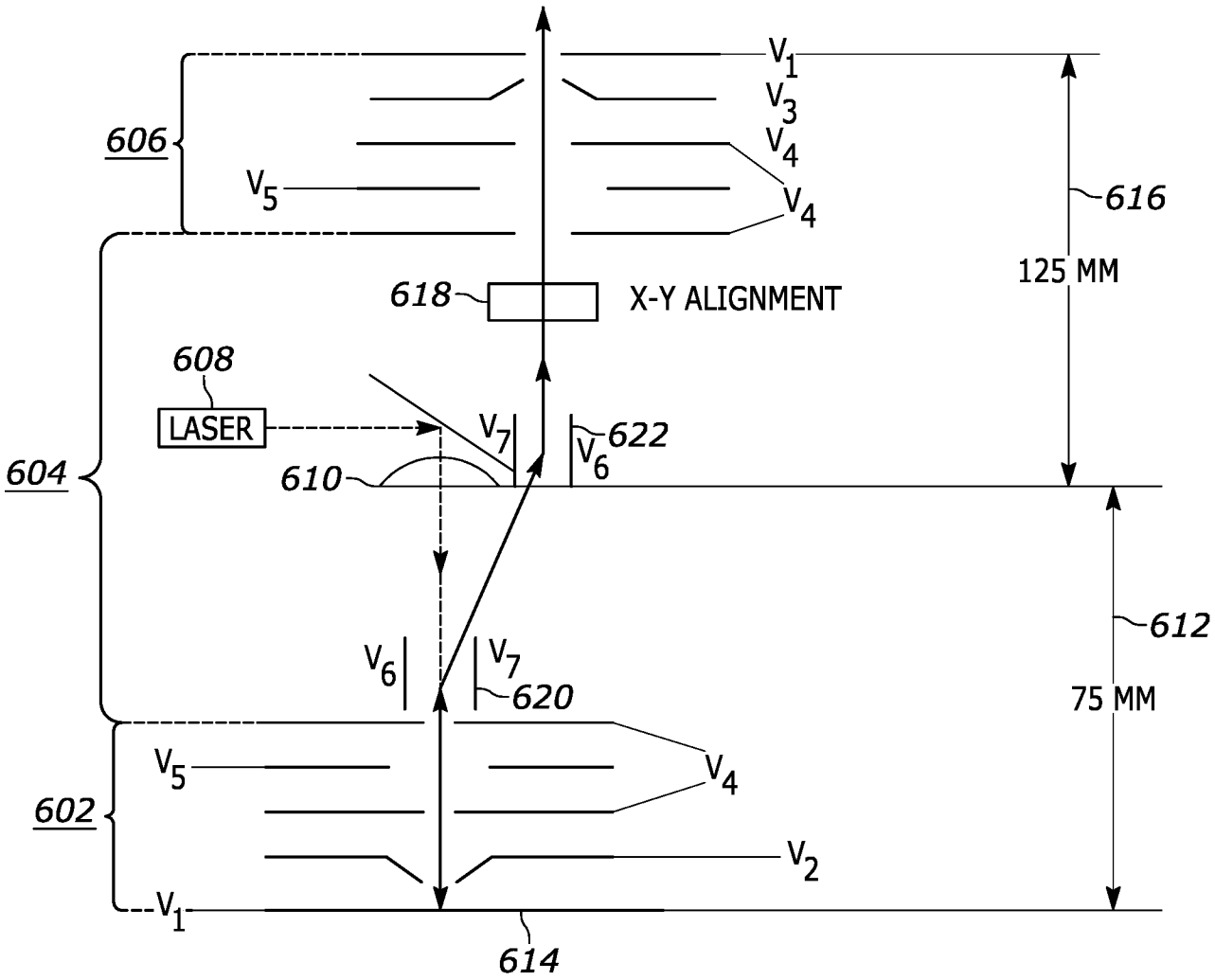
FIG. 6 illustrates a schematic diagram of a MALDI ion source for tandem mass spectrometer with two deflection electrodes according to one embodiment of the present teaching.

FIG. 6 illustrates a schematic diagram of a MALDI ion source for tandem mass spectrometer with two deflection electrodes according to one embodiment of the present teaching. An ion accelerator 602, ion optics 604 and ion decelerator 606 are detailed. Some embodiments target positive ions and the positions and dimensions of the electrodes are such that V1~+0 Volts, V2~−5000 Volts, V4~−10000 Volts, V5 is between 0 and 10,000 Volts and V6~−10000 Volts. In some embodiments, the dimensions of electrodes and voltages applied to the electrodes of the decelerator 606 and the accelerator 602 result in an ion decelerator 606 that is a mirror image of the ion accelerator 602. That is, the ion decelerator generates an electric field that is a mirror image of the electric field generated by the ion accelerator 602 that accelerates the pulse of ions so that the ion decelerator decelerates the accelerated pulse of ions and transmits the decelerated pulse of ions through an exit aperture.

The light from a laser 608 passes through a lens 610 that has a 75 mm focal length. A dimension 612 of the distance from the lens to the plane 614 where the sample resides is 75 mm, to match the focal length of the lens. A dimension 616 of the upper section in some embodiments is 125 mm. An X-Y alignment stage 618 is used to set the relative position of the ion optics 604 output and the decelerator 606 input. The two deflector electrode pairs 620, 622 separate the ions from the neutrals generated by the laser 608 pulses and direct them to the decelerator 606.

Figure 7:
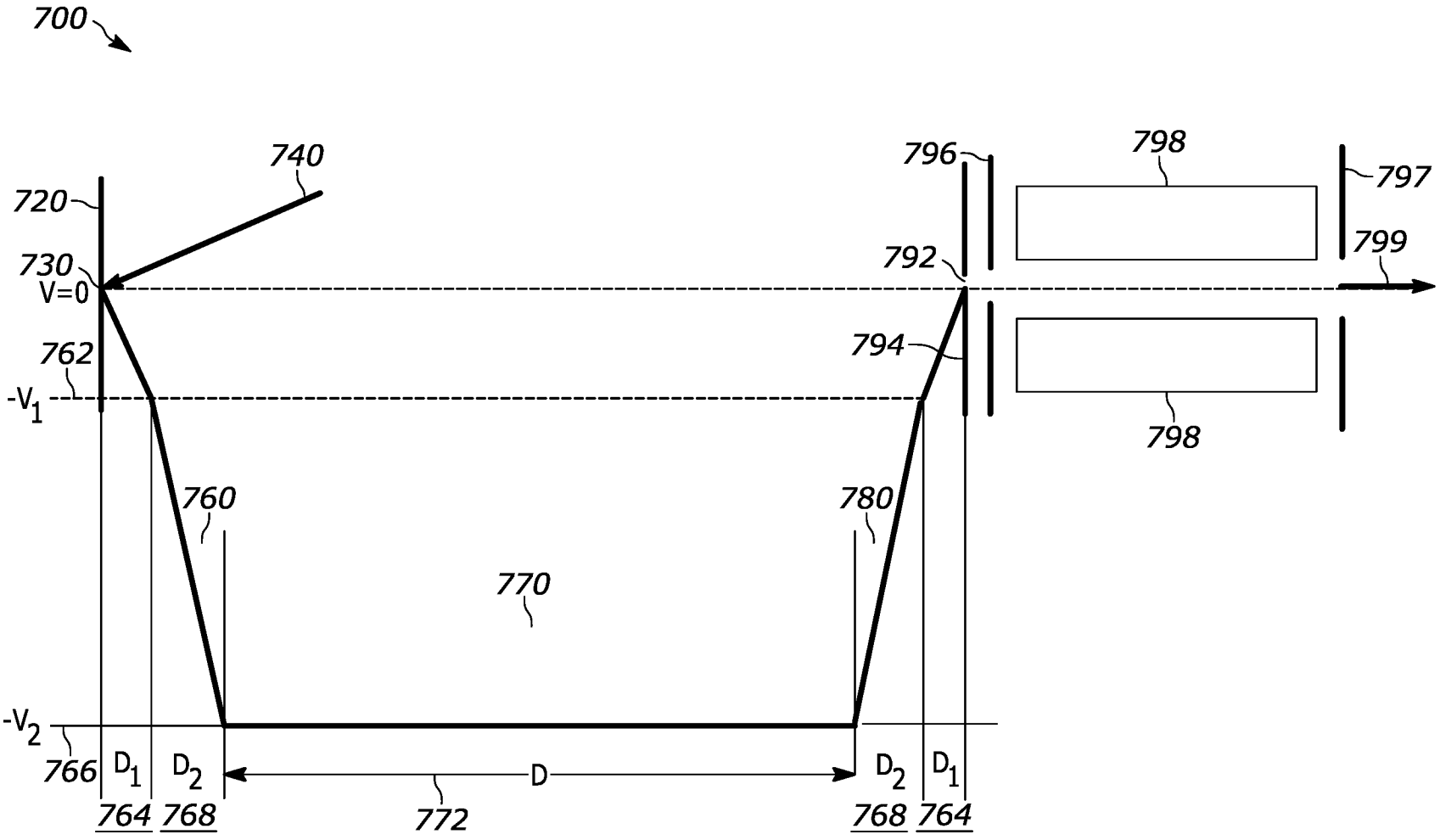
FIG. 7 illustrates a simplified diagram of a mass spectrometer that includes a potential diagram for an embodiment of a first mass spectrometer with MALDI ion source that can be used in a tandem spectrometer of the present teaching.

FIG. 7 illustrates a simplified diagram of a mass spectrometer 700 that includes a potential diagram for an embodiment of a first mass spectrometer with MALDI ion source that can be used in a tandem mass spectrometer of the present teaching. A sample plate 720 with a sample for analysis 730 is at ground potential, V=0, but one skilled in the art will appreciate that the sample plate 720 can be at other potentials as described herein. A pulse of energy 740, such as a laser pulse, impinges on the sample for analysis 730 positioned on the sample plate 720 and produces a pulse of ions during impact. The pulse of ions is accelerated by an accelerating field 760. Accelerating field 760 arises from a first potential produced by applying a voltage $-V_1$ 762 at an electrode positioned at distance $D_1$ 764 from the sample and a second potential produced by applying a voltage of $-V_2$ 766 at an electrode positioned at a distance $D_2$ 768 from the first electrode. In some embodiments, these potentials are applied, for example with two electrodes positioned in the ion accelerator 408 that is described in connection with FIG. 4.

The pulse of ions travels through an evacuated field-free region 770 and enters a decelerating field 780 that is the mirror image of accelerating field 760. Decelerating field 780 arises from a voltage $-V_2$ 766 applied at a first decelerating electrode positioned at distance D 772 from the last accelerating electrode and a voltage $-V_1$ 762 applied at an electrode a distance $D_2$ 768 from the first decelerating electrode and a ground potential at an electrode positioned at a distance $D_1$ 764 from the previous electrode. In some embodiments, these potentials are applied, for example with two electrodes positioned in the ion decelerator 418 that is described in connection with FIG. 4. The voltages are applied to electrodes positioned at spacings to achieve the distances $D_1$ 764 and $D_2$ 768 in the ion decelerator 418 and accelerator 408 of FIG. 4 such that the decelerator 418 is a mirror image of the accelerator 408.

In some embodiments, the accelerating voltages $V_1$ 762 and $V_2$ 766 are applied continuously, and then ions produced from sample 720 will arrive at exit plate 794 with substantially the same velocity and position relative to the axis of the accelerator 408 that they possessed initially. In some embodiments, the diameter of aperture 792 is at least as large as the diameter of the laser pulse impinging on sample plate 720, and then the velocity and spatial distribution of the ions reaching aperture 792 is substantially the same as the initial velocity and spatial distribution. The flight time of ions from sample plate 720 to exit plate 794 depends on the mass-to-charge ratio and initial velocity of the ions according to equations well known in the art. If an accelerating potential is applied to aperture plate 796, then the ions may be transmitted to quadrupole mass filter 798 with energy higher than their initial energy.

Quadrupole mass filter 798 is tuned to transmit ions with predetermined mass-to-charge ratio. Selected ions 799 are transmitted through aperture plate 797 and enter, for example, the fragmentation chamber 424 (FIG. 4) with predetermined ion energy as required by the fragmentation mechanism employed. In some embodiments, this ion energy may be in the range 10-100 eV, as compared to 5-20 Key after initial acceleration by accelerating field 760.

Figure 8:
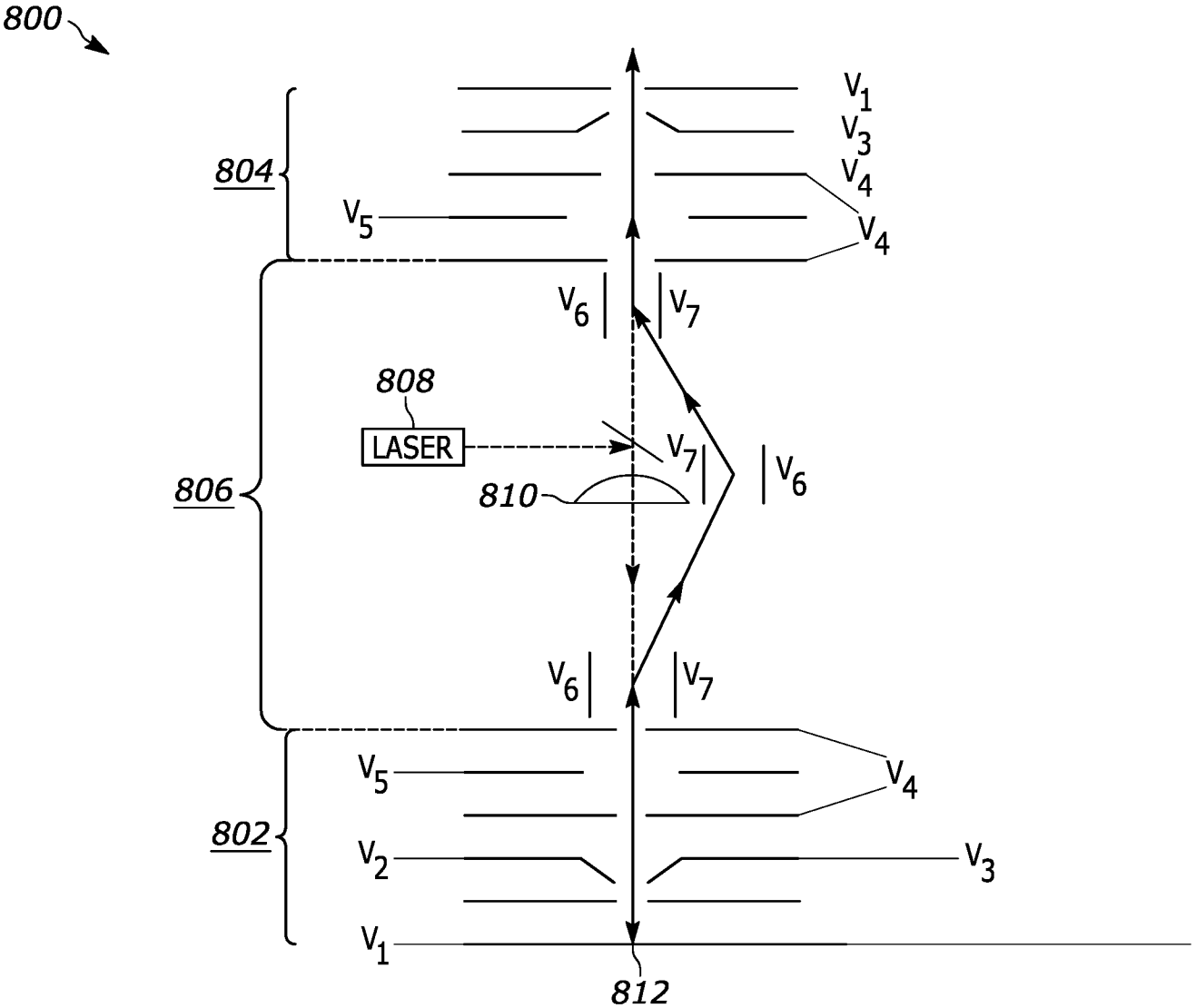
FIG. 8 illustrates a schematic diagram of a MALDI ion source for tandem mass spectrometer with three deflection electrodes according to one embodiment of the present teaching.

FIG. 8 illustrates a schematic diagram of a MALDI ion source 800 for tandem mass spectrometer with three deflection electrodes according to one embodiment of the present teaching. The subsystems include the accelerating optics 802, decelerating optics 804 and deflection optics 806. Some embodiments target positive ions and the positions and dimensions of the electrodes are such that V1~+0 Volts, V2~−5000 Volts, V4~−10000 Volts, V5 is between 0 and 10,000 Volts and V6~−10000 Volts. In this MALDI ion source 800, the central axis of the accelerating ion optics 802 is the same as the central axis of the decelerating ion optics 804. The dimensions and positions of the electrodes and voltages applied to the decelerator 804 comprise a decelerator that is a mirror image of the ion accelerator 802. The indicated voltages are applied continuously in both the accelerator 802 and the decelerator 804. The deflection optics 806 directs the ions created by energy from the laser 808 focused by lens 810 to a sample located at plane 812.

FIG. 9A illustrates a graph 900 of the relative intensity as a function of ion velocity for ions produced by an embodiment of the MALDI tandem mass spectrometer of the present teaching. FIG. 9B illustrates a graph 930 of the relative intensity as a function of their calculated energy produced by an embodiment of the MALDI tandem mass spectrometer of the present teaching. FIG. 9C illustrates a graph 950 of the relative intensity as a function of the ion time distribution at the exit aperture from the decelerator produced by an embodiment of the MALDI tandem mass spectrometer of the present teaching. When ions are accelerated in a static electric field it is well known in the art the velocity added by acceleration is independent of the initial velocity of the ions. Also, it is known with MALDI that the initial velocity distribution is substantially independent of the mass-to-charge ratio of the ions. Thus, in the symmetric acceleration-deceleration ion optics with static accelerating voltages as disclosed in the present teaching, the velocity distribution at the exit aperture is essentially unchanged relative to the initial velocity distribution. The energy distribution depends on the mass-to-charge ratio of the ions, as illustrated for m/z=1 kDa in FIG. 9B. The flight time to the exit aperture depends on both the mass of the ions and the geometry of the system as illustrated for one embodiment associated with the data presented in FIG. 9C. If an ion detector is placed adjacent to the exit aperture, measurement of the ion arrival time distribution for a pre-determined mass can be used to determine the initial velocity distribution.

Figure 10:
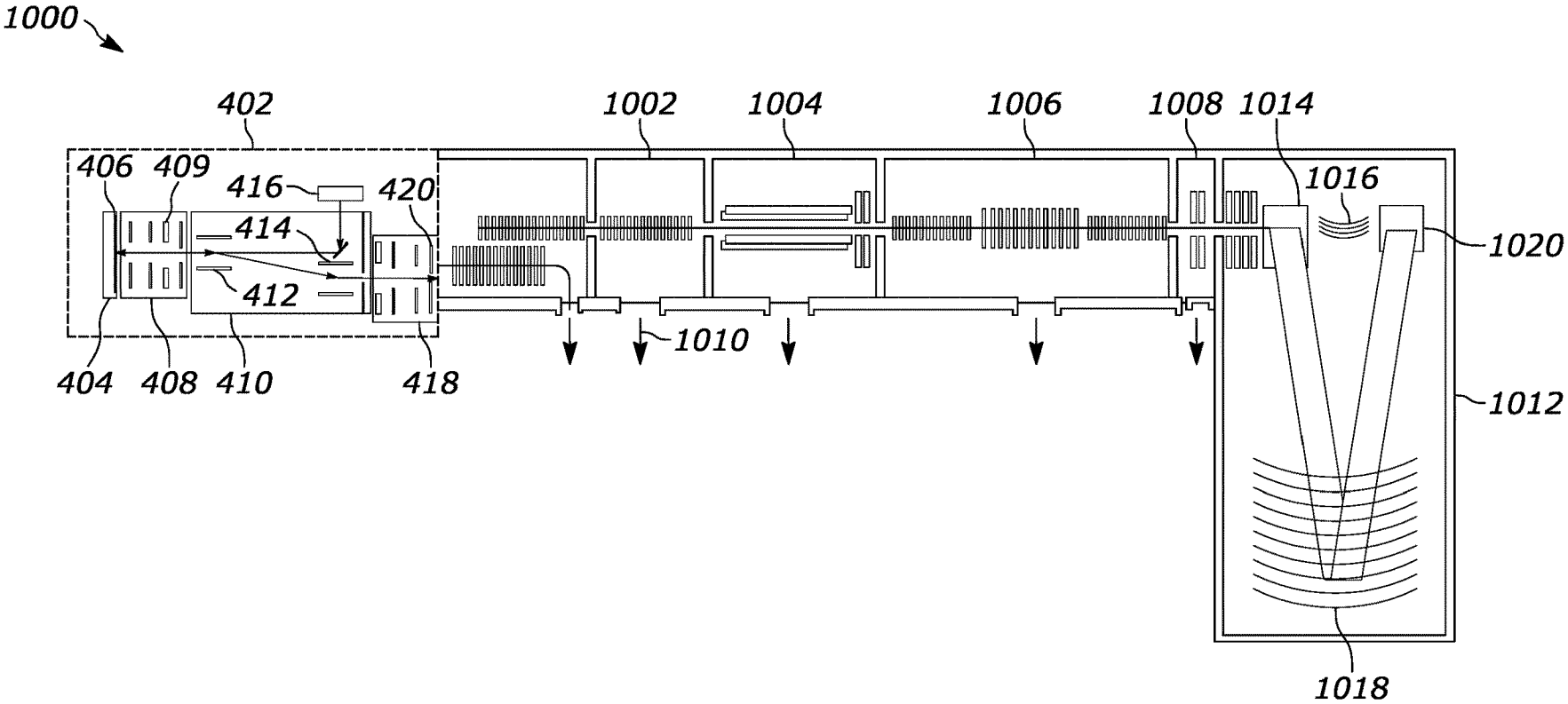
FIG. 10 illustrates a schematic of an embodiment of a tandem mass spectrometer with MALDI ion source and orthogonal second mass spectrometer according to the present teaching.

FIG. 10 illustrates a schematic of an embodiment of a tandem mass spectrometer 1000 with MALDI ion source and orthogonal second mass spectrometer according to the present teaching. The MALDI ion source 402 includes a sample plate receiver 404, a sample plate 406, an ion accelerator 408 and lens 409, ion optics 410 with two deflectors 412, 414, a laser 416, an ion decelerator 418 and exit aperture 420. The output of the MALDI ion source 402 is provided to an ion guide chamber 1002 in a chamber. The ion guide chamber may be a StepWave™ brand ion guide, manufactured by Waters, Corporation in Milford, Mass., that transfers ions from an input to an output that is off axis, removing neutrals that are expelled from the chamber 1002. The output of the ion guide chamber 1002 is input to a quadrupole analyzer chamber 1004 that further selects ions from the input and provides selected ions at an output. The output of the quadrupole analyzer chamber 1004 is input to a RF ion guide chamber 1006 that performs ion trap, accumulation, release, separation and fragmentation functions. The RF ion guide chamber 1006 separates ions at an output on the basis of size and shape. Some embodiments of the RF ion guide chamber 1006 include a trap and an ion mobility separation and ion transfer stage. Some embodiments comprise a TriWave™ ion guide chamber, manufactured by Waters, Corporation in Milford, Mass. The output of the ion guide chamber 1006 is input to an exit chamber

1008. Pressures in each chamber 1002, 1004, 1006, 1008 are controlled at various pressures via pressure outlets 1010 to provide desired ion transfer kinetics. A second mass analyzer 1012 is an orthogonal time-of-flight analyzer that includes a pusher 1014, ion mirror 1016, and ion reflectron 1018, and ion detection system 1020. The mass analyzer 1012 generates high-resolution mass spectra from the input ions. The mass analyzer 1012 may be a QuanTOF™ analyzer, manufactured by Waters, Corporation in Milford, Mass. The ion energy distribution can be modified as necessary by a static accelerator (not shown) between the exit aperture from the ion source 402 and the entrance into the quadrupole analyzer in chamber 1004.

Equivalents

While the Applicant's teaching is described in conjunction with various embodiments, it is not intended that the Applicant's teaching be limited to such embodiments. On the contrary, the Applicant's teaching encompass various alternatives, modifications, and equivalents, as will be appreciated by those of skill in the art, which may be made therein without departing from the spirit and scope of the teaching.

What is claimed is:

1. A MALDI ion source for tandem mass spectrometers, the MALDI ion source comprising:

a) a pulsed energy source that generates a pulse of ions from a sample on a sample plate;

b) an ion accelerator having an input that receives the pulse of ions from the pulsed energy source, the ion accelerator generating an electric field that accelerates the pulse of ions; and c) an ion decelerator that generates an electric field that is a mirror image of the electric field generated by the ion accelerator that accelerates the pulse of ions so that the ion decelerator decelerates the accelerated pulse of ions and transmits the decelerated pulse of ions through an exit aperture.

2. The MALDI ion source of claim 1 further comprising a first mass analyzer having an input that receives the decelerated pulse of ions transmitted through the exit aperture.

3. The MALDI ion source of claim 2 wherein the first mass analyzer comprises a timed ion selector that selects ions with a range of predetermined mass-to-charge ratios and provides the selected ions at an output.

4. The MALDI ion source of claim 3 further comprising a fragmentation chamber having an input coupled to the output of the first mass analyzer.

5. The MALDI ion source of claim 2 further comprising a second mass analyzer having an input coupled to the output of the first mass analyzer.

6. The MALDI ion source of claim 1 wherein the sample plate is electrically connected to ground potential.

7. The MALDI ion source of claim 1 wherein the exit aperture is electrically connected to the sample plate so that a potential on the exit aperture is equal to a potential on the sample plate.

8. The MALDI ion source of claim 1 wherein a diameter of the exit aperture is less than 100 micrometers.

9. The MALDI ion source of claim 1 further comprising an ion lens positioned in a field-free region between the ion accelerator and the ion decelerator.

10. The MALDI ion source of claim 9 wherein the ion lens is configured to minimize an ion beam diameter transmitted through the exit aperture.

11. The MALDI ion source of claim 1 further comprising ion deflectors positioned in a field-free region between the ion accelerator and the ion decelerator.

12. The MALDI ion source of claim 11 wherein the ion deflectors are configured to direct the accelerated pulse of ions so as to maximize a transmission of an ion beam transmitted through the exit aperture.

13. A tandem time-of-flight (TOF) mass spectrometer comprising:

a) a pulsed energy source that generates a pulse of ions from a sample on a sample plate;

b) an ion accelerator having an input that receives the pulse of ions from the pulsed energy source, the ion accelerator generating an electric field that accelerates the pulse of ions;

c) an ion decelerator that generates an electric field that is a mirror image of the electric field generated by the ion accelerator that accelerates the pulse of ions so that the ion decelerator decelerates the accelerated pulse of ions and transmits the decelerated pulse of ions through an exit aperture;

d) a first mass analyzer having an input positioned in the path of the decelerated pulse of ions transmitted through the exit aperture, the first mass analyzer selecting ions with a range of predetermined mass-to-charge ratios and providing the selected ion;

e) a fragmentation chamber having an input that receives the selected ion from the first mass analyzer, the fragmentation chamber fragmenting the selected ions; and f) a second mass analyzer configured to determine the mass-to-charge ratios of a portion of the fragments of the selected ions.

14. The tandem time-of-flight (TOF) mass spectrometer of claim 13 further comprising an ion lens positioned in a field-free region between the ion accelerator and the ion decelerator.

15. The tandem time-of-flight (TOF) mass spectrometer of claim 14 wherein the ion lens is configured to minimize an ion beam diameter transmitted through the exit aperture.

16. The tandem time-of-flight (TOF) mass spectrometer of claim 13 further comprising ion deflectors positioned in a field-free region between the ion accelerator and the ion decelerator.

17. The tandem time-of-flight (TOF) mass spectrometer of claim 16 wherein the ion deflectors are configured to direct the accelerated pulse of ions so as to maximize a transmission of an ion beam transmitted through the exit aperture.

18. The tandem time-of-flight (TOF) mass spectrometer of claim 13 further comprising an ion guide chamber positioned between the ion decelerator and the first mass analyzer.

19. The tandem time-of-flight (TOF) mass spectrometer of claim 13 further comprising an ion guide chamber positioned between the ion decelerator and the second mass analyzer.

20. The tandem time-of-flight (TOF) mass spectrometer of claim 13 wherein the second mass analyzer comprises a time-of-flight mass analyzer.

21. The tandem time-of-flight (TOF) mass spectrometer of claim 13 wherein the second mass analyzer comprises an orthogonal time-of-flight mass analyzer.

22. The tandem time-of-flight (TOF) mass spectrometer of claim 13 wherein the second mass analyzer comprises a quadrupole mass analyzer.

23. A method of tandem time-of-flight (TOF) mass spectrometry comprising:

a) generating a pulse of ions from a sample on a sample plate;

b) generating an accelerating electric field that accelerates the pulse of ions;

c) generating a decelerating electric field that is a mirror image of electric fields generated by the ion accelerator so that the ion decelerator decelerates the accelerated pulse of ions;

d) selecting ions from the decelerated pulse of ions with a range of predetermined mass-to-charge ratios;

e) generating fragments of the selected ions; and f) determining the mass-to-charge ratios of a portion of the fragments of the selected ions.

* * * * *